US006468133B1

(12) United States Patent
Dettling et al.

(10) Patent No.: US 6,468,133 B1
(45) Date of Patent: Oct. 22, 2002

(54) METHOD FOR TREATING FIBROUS WEBS

(75) Inventors: Bernhard Dettling, Chatenois (FR); Heikki Ahonen, Ritvala (FI)

(73) Assignee: IDI-Head Oy, Ritvala (FI)

( * ) Notice: Subject to any disclaimer, the term of this patent is extended or adjusted under 35 U.S.C. 154(b) by 0 days.

(21) Appl. No.: 09/600,184

(22) PCT Filed: Jan. 11, 1999

(86) PCT No.: PCT/FI99/00014

§ 371 (c)(1),
(2), (4) Date: Jul. 11, 2000

(87) PCT Pub. No.: WO99/35334

PCT Pub. Date: Jul. 15, 1999

(30) Foreign Application Priority Data

Jan. 12, 1998 (FI) ..... 980044

(51) Int. Cl.[7] ..... B24B 1/00

(52) U.S. Cl. ..... 451/28; 451/54; 451/167; 451/184; 29/90.1; 29/90.5

(58) Field of Search ..... 451/59, 54, 63, 451/28, 167, 168, 184, 300, 907; 29/90.1, 90.5

(56) References Cited

U.S. PATENT DOCUMENTS 2,349,704 A 5/1944 Clark
5,533,244 A 7/1996 Wadzinski
5,736,209 A * 4/1998 Andersen et al. ..... 428/36.4
5,810,961 A * 9/1998 Andersen et al. ..... 156/324

FOREIGN PATENT DOCUMENTS

GB 1 209 175 10/1970
WO 98/46829 10/1998

* cited by examiner

*Primary Examiner*—Eileen P. Morgan
(74) *Attorney, Agent, or Firm*—Smith-Hill and Bedell

(57) ABSTRACT

The present invention concerns a method for treating the surface of a fibrous web by mechanical grinding. According to the invention, the grinding is performed at substantially dry state by removing only the higher parts of the paper surface without substantially increasing the density of the web. By reducing the roughness of the surface by a maximum of 90%, the strength properties of the web remain essentially unchanged or they are even improved. Thus, when the roughness of the surface is reduced by about 40 to 60%, the tear strength increases with more that 5% in comparison to an untreated web. Papers and boards treated by the present method can be used for printing, packaging and wrapping.

19 Claims, No Drawings

METHOD FOR TREATING FIBROUS WEBS

The present invention relates to fibrous web finishing. In particular, the invention concerns a method according to the preamble of claim 1 for increasing the smoothness of paper and board webs by mechanical treatment.

Paper is normally manufactured by the wet method. According to that method fibres are suspended in water to form a fibrous furnish and a wet web is formed from the furnish on a wire screen. The web is then dried step by step using different mechanical and thermal systems to a preselected state of dryness.

In conventional technology, the fibrous furnish is maintained in turbulent state before web formation in order to avoid orientation of the fibres. However, as a result of the turbulence, there will be formed flocks in the web, having a fibre density larger than that of the surrounding parts of the web.

For the purpose of all printing operations, the surface of the paper should be as smooth and/or homogeneous as possible. The same is true for papers coated with mineral particle layer and latex binding materials. Therefore, very often (base) papers are calendered before coating and also papers containing mineral fillers are treated with a calender for achieving a smoother surface. Calendering is in particular necessary for certain paper qualities because of the above-mentioned flock formation.

There are numerous types of calenders, but all of them even the surface by mechanical pressing and sliding forces. Conventional calendering is hampered by some considerable disadvantages. After remoisturing, a surface smoothened by calendering will totally or partially regain its original form. It is also known that papers loose up to 35–40% of its strength properties and 25–35% of its original opacity as a result of calendering. Further, the original tenacity of the paper web will remarkably decrease.

In view of the above problems related to calendering, great efforts have been made to avoid said flock formation and to find some different methods for surface smoothening.

U.S. Pat No. 2,349,704 discloses a method for polishing the surface of a paper web with a cloth polishing roll. The surface of the roll contains a powdered abrasive which is bound to the surface with the aid of a binder. The object is to press and polish paper to the same extent as is made by the supercalendering process, and according to specification of the patent, the density of the treated paper is the same as after a supercalendering process and gloss, measured by a Baush & Lomb glossmeter, is 10 points higher than before the treatment.

U.S. Pat. No. 5,533,244 discloses another method, somewhat similar to the one mentioned above, for polishing paper with a woven belt which slides at different speed over the paper web than the web itself, producing frictional action.

A soft calender device which acts as a rubbing friction device on paper surface is disclosed in U.S. Pat. No. 4,089,738. The device will smoothen the paper surface in the same way as original supercalenders.

None of the prior art method will provide for a satisfying removal of high density flocks from the paper surface. Further, it is apparent that the strength properties of the paper deteriorate during the application of the known methods.

It is, therefore, an object of the present invention to eliminate the disadvantages of the prior art and to provide a novel method for treating the surface of a fibrous web, in particular a paper or board surface in order to improve its smoothness while substantially retaining the mechanical properties of the web.

The present invention is based on the surprising finding that the surface of many fibrous webs can be smoothen by grinding off only the most protruding parts of the web with a grinding means, such as a grinding belt or viberating grinding device or rotating grinding cylinder, to provide a smoothened surface having unaltered or even improved properties of mechanical strengthness. In particular, the presention comprises grinding in the dry state ("dry grinding") only the higher parts of fibrous web (in cross section) while pressing the surface against the grinding surface so little that no noticeable increase of density of the web can be found.

More specifically, the invention is mainly characterized by what is stated in the characterizing part of claim 1.

The present invention provides a number of advantages. Surprisingly, it has been found that, e.g., ground paper had a better tensile strength and also better bursting strength that the original paper. Although we do not wish to be bound by any particular theory, it would appear that this phenomenon is based on the forces inside the stressed web becoming more evenly distributed when the strength of the parts having the highest strength is decreased. Initially, because of the poor evenness (formation) of the paper web, the forces are not so strong at the thinnest part of the paper. However, grinding will redistribute the adhesion forces within the web matrix. Another possible explanation is that fines generated obviously during the grinding process and also fibrils, one end of which still sticks to the original fibre, are reassembled on the surface.

During the surface grinding process of the present invention, very limited amounts of loose fibres and dust are formed. This is probably because the grinding friction of the present invention will release some water vapour from the surface and it will condense on the paper leaving the grinding process part of machinery. This condensed water will bind fines back to the surface.

Next the invention will be examined in more detail with the aid of the following detailed description and with reference to a working example.

Within the scope of the present invention, the terms "cellulosic" and "lignocellulosic" are used to designate materials derived from cellulose and lignocellulosic materials, respectively. In particular "cellulosic" refers to material obtainable from chemical pulping of wood and other plant raw material. Thus, a web containing "cellulosic fibres" is made for example from kraft, sulphite or organosolv pulp. "Lignocellulosic" refers to material obtainable from wood and other plant raw material by mechanical defibering, for example by an industrial refining process, such as refiner mechanical pulping (RMP), pressurized refiner mechanical pulping (PRMP), thermomechanical pulping (TMP), groundwood (GW) or pressurized groundwood (PGW), or chemithermo-mechanical pulping (CTMP) or any other method for manufacturing a fibrous material which can be formed into a web and coated.

The terms "paper" and "paperboard" refer to sheet-formed products containing cellulosic or lignocellulosic fibres. "Paperboard" is synonymous with "cardboard". The grammage of the paper or paperboard can vary within broad ranges from about 30 to about 500 g/m$^2$. The roughness of the web which is to be treated in about 0.1 to 30 $\mu$m, preferably about 1 to 15 $\mu$m. The present invention can be employed for treating any desired paper or paperboard web. As a practical matter, the term "paper" or "paper web" is herein used to designate both "paper" and "paperboard" and "paper web" and "paperboard web", respectively.

The terms "fines", "fibrils" and "fibres" denote finely divided material having a cross-sectional diameter of less than about 10 μm, typically in the range of 0.001 to 2 μm and the "fibrils" and "fibres" are materials having a length to cross-section diameter ratio of more than about 6.

The "roughness" of the web which is to be coated is generally given as "microns" (μm). The print-surf surface roughness at 1000 kPa can be measured according to, for example, ISO 8791-4:1992 (E). Typically the roughness of paper webs is in the range of 8 to 2 microns. As discussed below and shown in the working examples, by subjecting the surface of a paper or paperboard web to a grinding treatment according to the invention, it is possible to reduce the roughness of the web by at least 20%, preferably about 40 to 60% while maintaining the mechanical properties of the web.

The present invention comprises the steps of forming a wet web from a fibrous furnish on a wire screen. The web is then dried on a paper or board machine to preselected state of dryness. At any desired point of the drying, but preferably after the web has been dried to sufficient dryness to impair reasonable mechanical strength on the web, the web is subjected to a dry grinding operation as explained in more detail below. The grinding can be carried out between the unwinding and winding of the web. After the grinding and possible smoothing, the treated web can then be coated with suitable coating colours as known per se.

The grinding according to the invention is carried out by contacting the surface of the paper web with a grinding means. According to a preferred embodiment of the present grinding process, the grinding is made by grinding grains fixed to a movable grinding belt or a vibrating plate which produces a not glossy but faded or mat surface. The preferable size of the grinding media grains is between about 5–20 micron, of course depending on the surface quality and the surface weight of the paper or board. The surface of the grinding medium is essentially dry (moisture content less than about 50%, preferably less than 20% and in particular less than 10%) and preferably no water is fed between the web and the grinding medium during grinding.

According to the present invention, it is essential that the higher points, i.e. the "hills". are ground away from the paper surface and for fulfilling this goal the grinding belts back support and the papers support must be built so that only higher level parts from papers surface are removed. Generally, the roughness of the surface, as measured in micrometers, is reduced by 10 to 90%, preferably about 40 to 60%, after grinding.

During grinding, the web is subjected to a grinding energy on the order of 700 to 14,000 J/m$^2$, preferably about 2,000 to 8,000 J/m$^2$. According to a particularly preferred embodiment, the web is subjected to 2,000–3,000 J/m$^2$ grinding energy/micron roughness of the web. As mentioned above, the mechanical properties of the paper or board remain unchanged by the grinding according to the present invention. They can even be improved by the grinding as explained above. Thus, when the roughness of the surface is reduced by a maximum of 90% the strength properties of the web will remain essentially unchanged or they are improved. When the roughness of the surface is reduced by about 40 to 60% the tear strength is increased with at least 5% (preferably over 10%) in comparison to an untreated web.

A visual inspection of a paper treated by the present grinding method reveals that the opacity of the paper is not significantly changed when 40 to 60% of hills and similar irregularities on the surface have been subjected to grinding. At the same time, the mechanical strength of the paper is excellent.

The pressure exerted on the web can vary within a wide large as long as no significant compressing of the paper takes place. This would otherwise weaken the mechanical strength of the web. Generally, the surface pressure of the grinding should be about 0.01 to 20 kPa, preferably about 1 to 10 kPa.

After the grinding it is advantageous to remoisturize the treated surface and press it slightly against a very smooth surface or against a moving smooth surface for getting all loose fibres and fines back to the surface. This treatment will even further smoothen the ground surface. For moisturizing, steam or water vapour can be used as well as a mist containing evenly distributed small droplet produced by, e.g., an ultrasonic treatment, and which can be attached to the surface by ionization methods.

In an article titled "Friction in Wood Grinding" (Paper and Timber, Vol. 79 (1997) No. 4) wood grinding with a grinding stone is discussed in some detail. The authors claim that a grinding speed of less than 7 m/s is totally ineffective and that only at speeds of 10 to 30 m/s the grinding stone will release some fibers from wood. At lower speed only some unwanted fibrillation will take place on the contact surface of wood.

The present invention is based on the opposite concept: we do not want to release whole fibers from the surface of the paper or board web, but instead only fibrils and loose parts of fibers. Therefore, the velocity difference can, according to the present invention, be in the range of 1 to 10 m/s and still satisfying results are obtained. However, according to another embodiment the higher the speed difference between the belt and paper or board to be grinded, the better the result. The best way to do it is to arrange the belt and web to be running in the same direction but with different speed. This provides for efficient removal of dust. High grinding speed is advantageous for two different reasons: firstly, it will prevent dust and fines from gathering on the belt and, secondly, at high speed the surface pressure can be kept low and melting of resins, lignin etc. does not take place on the surface and so the grinding belt or other grinding media surface will not to be blocked. The critical speed depends on the wood or pulp quality from which the paper or board has been made and also on the quality of the grinding particles on the grinding media surface. The grinding speed and pressure must nevertheless always be kept on a level where no local heating will happen to the extent that resins and lingnins are softened. Should this happen, the grinding medium would soon be clogged with fibres, resins, lignin and loose dust from the web.

According to a preferred embodiment, wherein a belt grinder comprising a dry belt of a polymeric material is used, the fibrous belt is friction electrified as a result of the grinding. Therefore, fibrils and fine particles released from the web by the grinding are rebound to the surface by electrostatic forces between the fibrils and the web. No dusting of the web takes place. The electrical loading of the surface can also be effected before grinding in order to increase the electrical load of the surface.

By treating the fibrous web with cationized starch or a similar cationic material, conventionally used for improving retention of pigments or fines on the wire of a paper or board machine, the cationic material will effectively bind fibrils loosened during the grinding process to the surface.

According to a further preferred embodiment, the ground surface, which as mentioned above, is usually faded or mat after grinding, can be made glossy by moisturizing it slightly with steam and pressing it against a smooth surface.

A paper or board treated according to the present invention can be coated or used as such optionally after glossing with a conventional calender or, preferably as explained above, after moisturizing. For coating purposes the paper can be provided with a polymer layer, a barrier layer, a laquer or with normal coating colours. These papers and board are particularly suitable for printing and writing and ink jet printing. Untreated optionally glossy-quality products are also suitable for packaging, wrapping and bagging purposes.

The following non-limiting example illustrates the invention:

EXAMPLE

Test specimens of a paper kept dry at a relative humidity of 50% and having a surface weight of 114 g/m$^2$ and a thickness of 0.16 mm were subjected to the grinding action of a belt having a coarseness of 15 micron running at different velocities. The results are summarized in Table 1.

TABLE 1

Smoothness and mechanical properties of paper ground with a belt running at different velocities

| | Smoothness microns | Tear strength kN/m | Bursting strength kPa |
|---|---|---|---|
| 0-sample | 7.5 | 5.49 | 178 |
| Belt velocity 3.6 m/s | 3.2 | 6.05 | 250 |
| Belt velocity 5.3 m/s | 3.0 | 5.89 | 240 |

Another set of test specimens comprising the same paper quality was subjected to grinding with a vibrating medium having an average velocity of 0.36 m/s. The results appear from Table 2.

TABLE 2

Smoothness and mechanical properties of paper ground with a vibrating medium

| Grinding medium particle size | Smoothness microns | Tear strength kN/m | Bursting strength kPa |
|---|---|---|---|
| 0-sample | 7.5 | 5.49 | 178 |
| 18.5 micron | 3.5 | 5.66 | 235 |
| 15 micron | 3.2 | 5.66 | 240 |
| 12 micron | 3.1 | 5.56 | 246 |

Vibrating grinding did show up quite soon worsening of the grinding plate, but belt grinder did keep itself clean long times.

Grinding both sides of paper samples 1 or 2 times with a 15 micron particle belt grinder gave the following results:

TABLE 3

Grinding of paper sample on both sides 1 and 2 times; belt velocity 5,3 m/s; 15 micron particle size

| | 1 time | 2 times | 2 times + steam wetting + pressing with 600 N/m |
|---|---|---|---|
| Tearstrength, kN/m | 6.85 | 6.48 | 6.95 |
| Smoothness, microns | 6.0 | 5.0 | 6.5 |

By reference, the tear strength of an untreated paper was 5.55 kN/m and the smoothness 9.0 micron.

By reference, the tear strength of an untreated paper was 5.55 kN/m and the smoothness 9.0 micron.

What is claimed is:

1. A method for treating a surface of a fibrous web of paper or board for printing, packaging or wrapping, wherein said surface has higher parts due to roughness of the surface, comprising:

subjecting the web surface to mechanical grinding in a dry state, the mechanical grinding being limited to removing only higher parts of the web surface without substantially increasing the density of the web, and wherein the paper or board has a surface weight of 30 to 500 g/m$^2$ and a roughness of 1–15 $\mu$m.

2. The method according to claim 1, comprising reducing the roughness of the web surface by a maximum of 90%.

3. The method according to claim 2, comprising reducing the roughness of the web surface by 40–60%.

4. The method according to claim 1, comprising coating the web surface with material ground from the web surface.

5. The method according to claim 1, comprising coating the web surface with fines and/or fibers ground from the web surface.

6. The method according to claim 1, comprising contacting the web surface with a grinding surface moving with a sufficiently low velocity relative to the web surface such that resin or lignin on said web surface does not melt.

7. The method according to claim 1, wherein the web has two opposite surfaces and the method comprises subjecting both web surfaces to grinding.

8. The method according to claim 1, comprising contacting the web surface with a grinding device selected from grinding belts, grinding plates and rotation grinding cylinders.

9. The method according to claim 8, comprising subjecting the paper web to a grinding energy on the order of 700 to 14,000 J/m$^2$.

10. The method according to claim 8, comprising subjecting the paper web to a grinding energy on the order of 2,000 to 3,000 J/m$^2$ per micrometer of reduced roughness.

11. The method according to claim 8, wherein the grinding device comprises grinding medium grains having a size of 2 to 50 micrometers, preferably about 5 to 20 micrometers.

12. The method according to claim 1, comprising subjecting the paper web to a surface pressure of about 0.01 to 20 kPa, preferably about 1 to 10 kpa, during grinding.

13. The method according to claim 12, comprising contacting the web surface with a grinding surface provided with grinding medium grains having a size of 2 to 50 micrometers, preferably about 5 to 20 micrometers.

14. The method according to claim 1, comprising contacting the web with a grinding belt comprising a polymer as belt material in order to increase the electrical charge of the web surface during grinding.

15. The method according to claim 1, comprising treating the web with a cationic material for providing a cationic surface on the web which binds material released during grinding.

16. The method according to claim 1, comprising moisturizing the web surface slightly with steam or evenly distributed droplets after grinding and contacting the moisturized surface with a smooth surface in order to increase further the smoothness of the web surface.

17. The method according to claim 16, comprising pressing the moisturized surface against, or sliding the moisturized surface along, said smooth surface.

18. A method for treating a surface of a fibrous web of paper or board for printing, packaging or wrapping, wherein said surface has higher parts due to roughness of the surface, comprising:

contacting the web surface with a grinding device selected from grinding belts, grinding plates and rotation grinding cylinders, and subjecting the web surface to mechanical grinding in a dry state employing a grinding energy on the order of 700 to 14,000 $J/m^2$, the mechanical grinding being limited to removing only higher parts of the web surface without substantially increasing the density of the web.

19. A method for treating a surface of a fibrous web of paper or board for printing, packaging or wrapping, wherein said surface has higher parts due to roughness of the surface, comprising:

subjecting the web surface to mechanical grinding in a dry state, the mechanical grinding being limited to removing only higher parts of the web surface without substantially increasing the density of the web, and moisturizing the web surface slightly with steam or evenly distributed droplets after grinding and contacting the moisturized surface with a smooth surface in order to increase further the smoothness of the web surface.

* * * * *